US009669434B2

(12) United States Patent
Fujita et al.

(10) Patent No.: US 9,669,434 B2
(45) Date of Patent: Jun. 6, 2017

(54) MOP WITH STAND

(71) Applicant: Helen of Troy Limited, Belleville, St. Michael (BB)

(72) Inventors: Terumasa Fujita, Brooklyn, NY (US); Joern Vicari, San Francisco, CA (US); David Colie Wight, West Orange, NJ (US)

(73) Assignee: Helen of Troy Limited, Belleville, St. Michael (BB)

( * ) Notice: Subject to any disclaimer, the term of this patent is extended or adjusted under 35 U.S.C. 154(b) by 4 days.

(21) Appl. No.: 14/806,151

(22) Filed: Jul. 22, 2015

(65) Prior Publication Data

US 2017/0020358 A1 Jan. 26, 2017

(51) Int. Cl.

| | |
|---|---|
| ***A47L 13/146*** | (2006.01) |
| ***A47L 13/257*** | (2006.01) |
| ***A47L 13/258*** | (2006.01) |
| ***B08B 1/00*** | (2006.01) |

(52) U.S. Cl.

CPC ..... *B08B 1/006* (2013.01); *A47L 13/146* (2013.01); *A47L 13/257* (2013.01); *A47L 13/258* (2013.01)

(58) Field of Classification Search

CPC ..... A47L 13/146; A47L 13/257; A47L 13/258
See application file for complete search history.

(56) References Cited

U.S. PATENT DOCUMENTS

| | | | | |
|---|---|---|---|---|
| 2,176,908 | A | 10/1939 | Korner et al. | |
| 2,967,317 | A | 1/1961 | Richards | |
| 3,137,878 | A | 6/1964 | Richards | |
| 3,147,502 | A * | 9/1964 | Richards | A47L 13/146 15/118 |
| 4,059,864 | A | 11/1977 | Spresny | |
| 4,455,705 | A | 6/1984 | Graham | |
| 5,161,772 | A * | 11/1992 | DiResta | A46B 15/00 15/111 |
| 5,659,916 | A | 8/1997 | Beatty et al. | |
| 6,026,530 | A | 2/2000 | Camp, Jr. | |
| 6,370,725 | B1 | 4/2002 | Carlson | |
| 8,132,283 | B1 | 3/2012 | Downes | |
| 8,713,742 | B2 | 5/2014 | Pellacini | |
| 2006/0037159 | A1 | 2/2006 | Wang | |
| 2006/0137121 | A1 * | 6/2006 | Niccolai | A47L 13/146 15/119.2 |
| 2007/0151056 | A1 | 7/2007 | Zhu et al. | |

* cited by examiner

*Primary Examiner* — Randall Chin
(74) *Attorney, Agent, or Firm* — Rankin, Hill & Clark LLP

(57) ABSTRACT

A mop includes a handle rod, a mop head, and an actuator handle. The handle rod defines a central handle rod axis. The mop head connects with the handle rod and includes a cleaning element mounting structure, a cleaning element, and a standoff. The actuator handle connects with the handle rod and the cleaning element mounting structure. The actuator handle is movable with respect to the handle rod for moving the mop head with respect to the handle rod between a use position and a storage position.

17 Claims, 7 Drawing Sheets

MOP WITH STAND

BACKGROUND

Sponge mops are used for washing floors. In general, a sponge mop includes an elongated handle rod having a mop head connected at a lower end of the handle rod. The mop head is typically wetted or dampened while washing the floor. Afterwards, the mop head is cleaned from collected dirt and debris before using the mop again.

Oftentimes, the cleaning element of the mop is still wet after the cleaning job is finished. To aid in drying the cleaning element, it is desirable to expose as much surface area as possible on the cleaning element to ambient. In known sponge mops, a hole is provided at an upper end of the handle rod so that the mop can be hung from a hook to allow the cleaning element to air dry. If the operator does not wish to hang the mop on a hook, other means for exposing the mop head to ambient, such as resting the upper end of the mop handle on the floor can be used.

SUMMARY

In view of the foregoing, a mop including a handle rod, a mop head, and an actuator handle is provided. The handle rod defines a central handle rod axis. The mop head connects with the handle rod and includes a cleaning element mounting structure, a cleaning element connected with the cleaning element mounting structure, and a standoff extending from the cleaning element mounting structure. The actuator handle connects with the handle rod and the cleaning element mounting structure. The actuator handle is movable with respect to the handle rod for moving the mop head with respect to the handle rod between a use position and a storage position. When the mop head is in the use position, a cleaning surface of the cleaning element is nearer to normal to the central handle axis as compared to parallel to the central handle axis. When in the storage position, the cleaning surface is nearer to parallel with the central handle axis as compared to normal to the central handle axis and a support surface on the standoff is positioned to offset the cleaning element from a flat horizontal surface upon which the support surface rests.

An example of operating a mop that may overcome the aforementioned shortcomings includes moving an actuator handle, which is connected with a handle rod, with respect to the handle rod into a use operating position such that a cleaning surface of a cleaning element on a mop head is in contact with a floor surface. The method can further include moving the actuator handle with respect to the handle rod from the use operating position to a storage operating position such that a standoff on the mop head contacts the floor surface and the cleaning element is offset from the floor surface.

Another example of a mop includes a handle rod, a mop head, an actuator handle, and a linkage. The mop head connects with the handle rod for pivotal movement with respect to the handle rod about a mop head/handle rod axis. The mop head includes a cleaning element having a cleaning surface and a standoff having a support surface spaced from the cleaning surface. The mop head pivots with respect to the handle rod about the mop head/handle rod axis between a use position where the cleaning surface is resting on an associated floor surface and the support surface is offset from the associated floor surface and a storage position where the support surface is resting on the associated floor surface and the cleaning surface is offset from the associated floor surface. The actuator handle connects with the handle rod for pivotal movement with respect to the handle rod about an actuator handle/handle rod axis. The linkage connects the actuator handle and the mop head such that movement of the actuator handle results in movement of the mop head. The linkage connects with the mop head for pivotal movement about a mop head/handle actuator link axis that is parallel with the mop head/handle rod axis.

DETAILED DESCRIPTION

Figure 1:
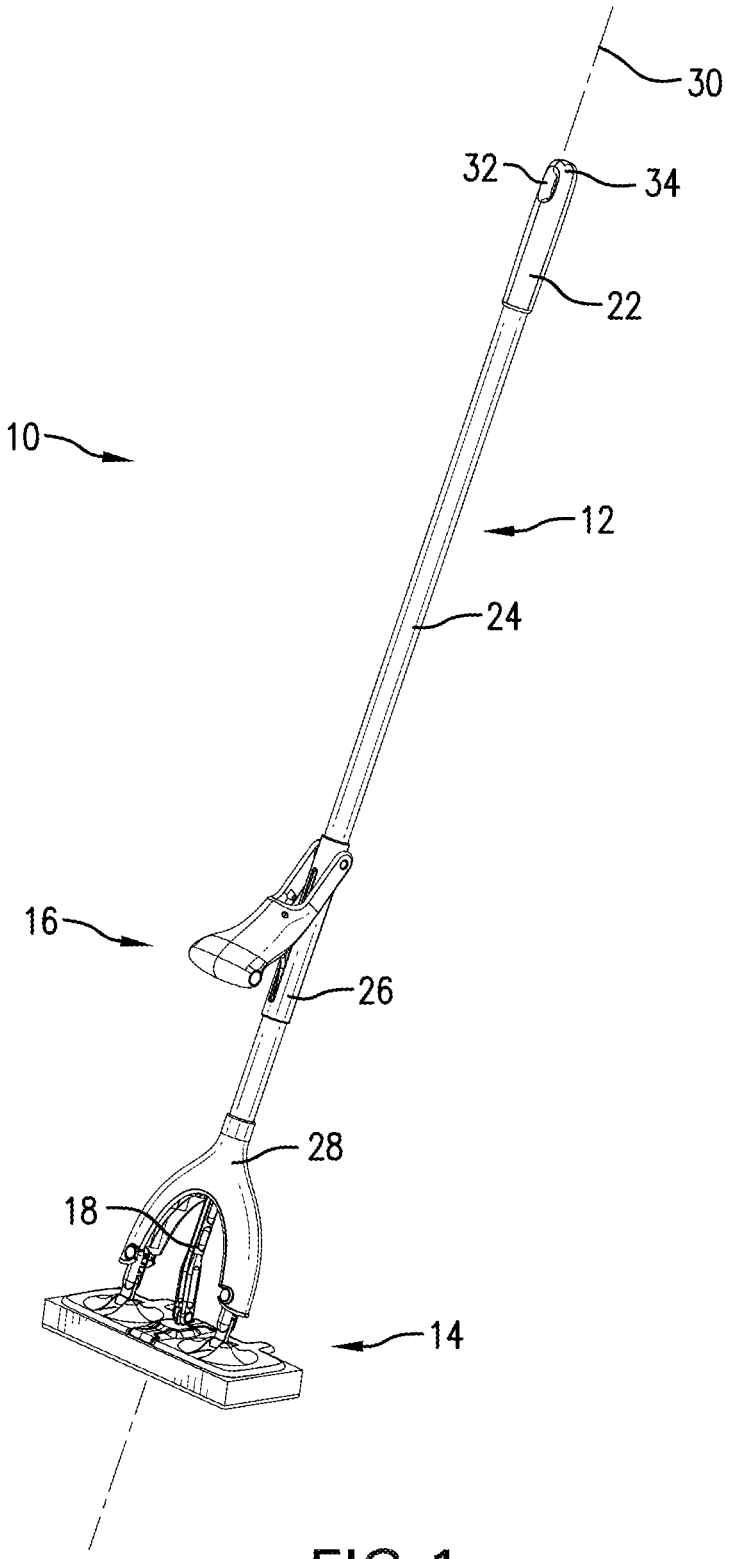
FIG. 1 is a front perspective view of a mop with a mop head in a use position and an actuator handle in a use operating position.
Figure 2:
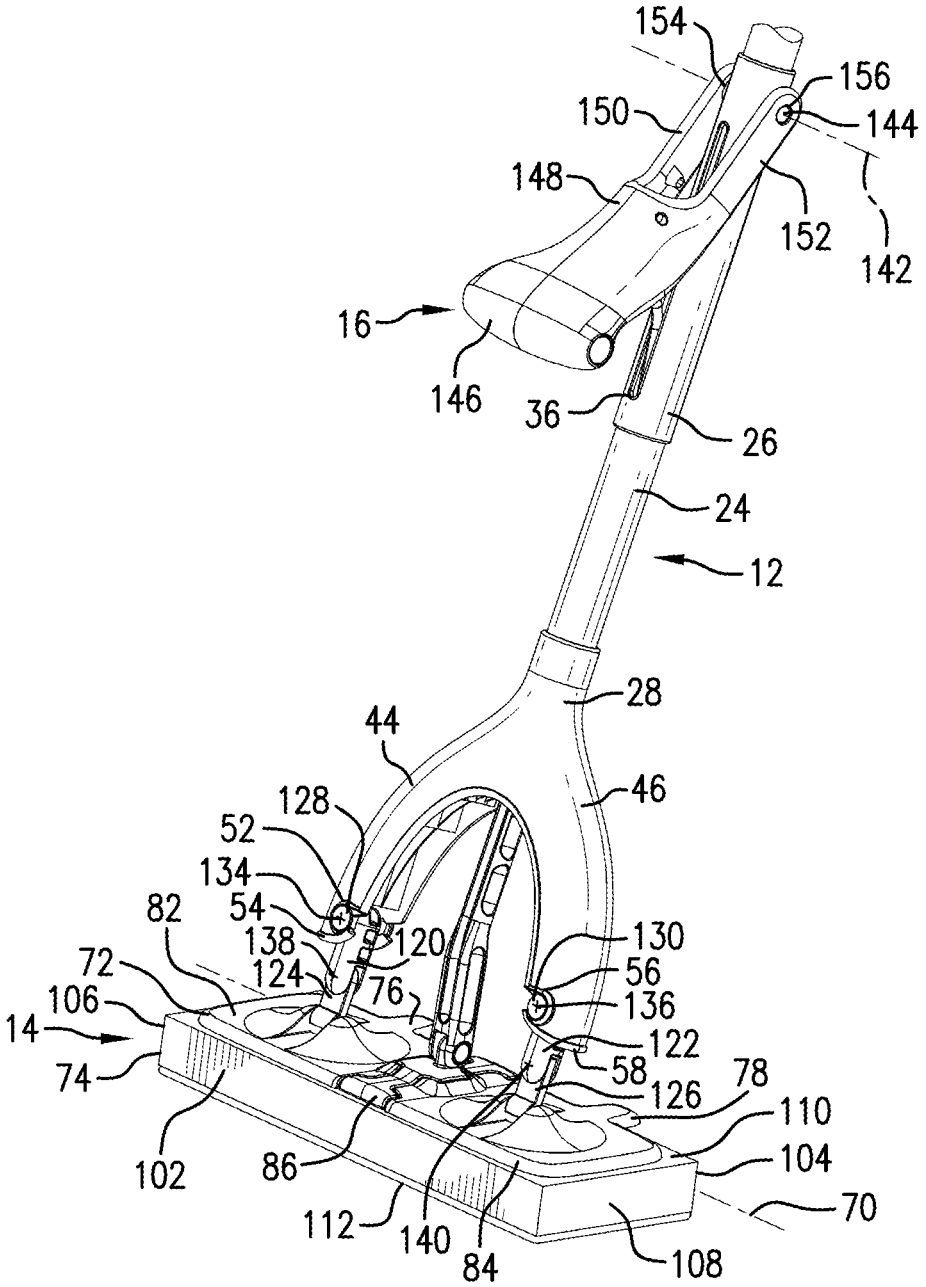
FIG. 2 is a close up view of a lower portion of the mop shown in FIG. 1.
Figure 3:
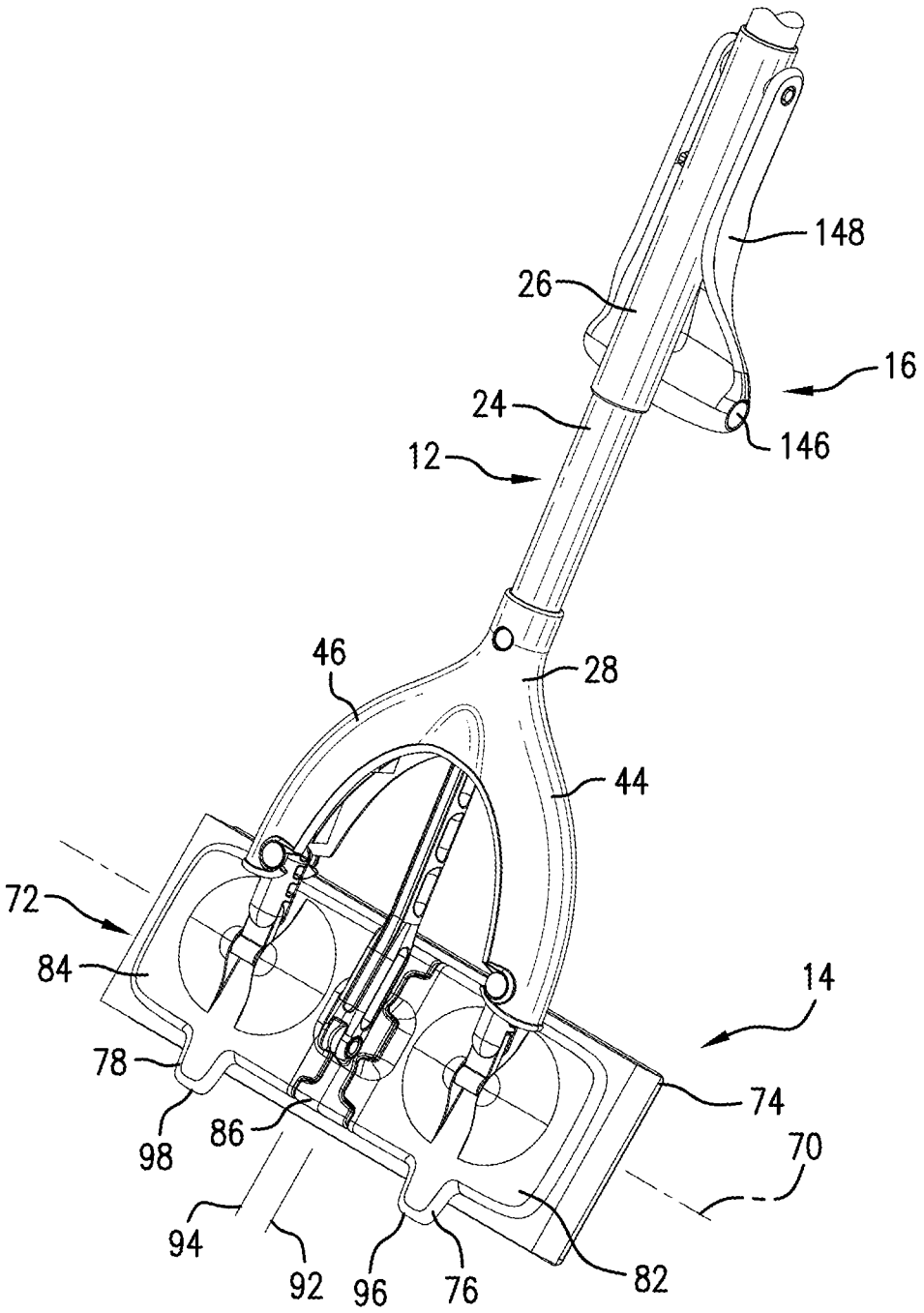
FIG. 3 is a rear perspective view of the lower portion of the mop of FIG. 1 with the mop head in a storage position and the actuator handle in a storage operating position.
Figure 4:
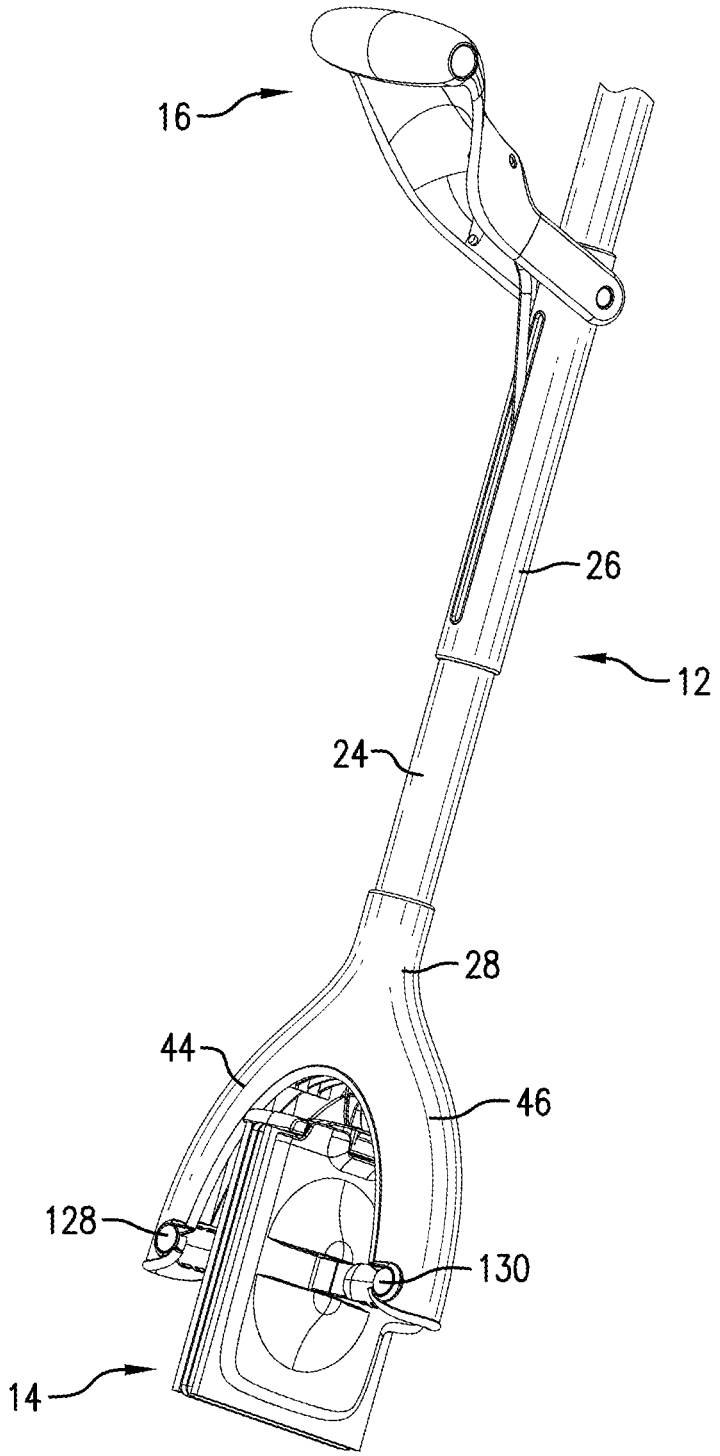
FIG. 4 is a front perspective view of the lower portion of the mop of FIG. 1 with the mop head in a wring position and the actuator handle in a wring operating position.

With reference to FIG. 1, a mop 10 includes a handle rod 12, a mop head 14, and an actuator handle 16. The mop 10 also includes a linkage 18 (see also FIG. 7) connecting the actuator handle 16 and the mop head 14. The mop head 14 and the actuator handle 16 are both movable (pivotable in the illustrated embodiment) with respect to the handle rod 12 into different positions. FIGS. 1 and 2 depict the mop head 14 in the use position and the actuator handle 16 in the use operating position. FIG. 3 depicts the mop head 14 in a storage position and the actuator handle 16 in a storage operating position. FIG. 4 depicts the mop with the mop head 14 in a wring position and the actuator handle 16 in a wring operating position.

Figure 7:
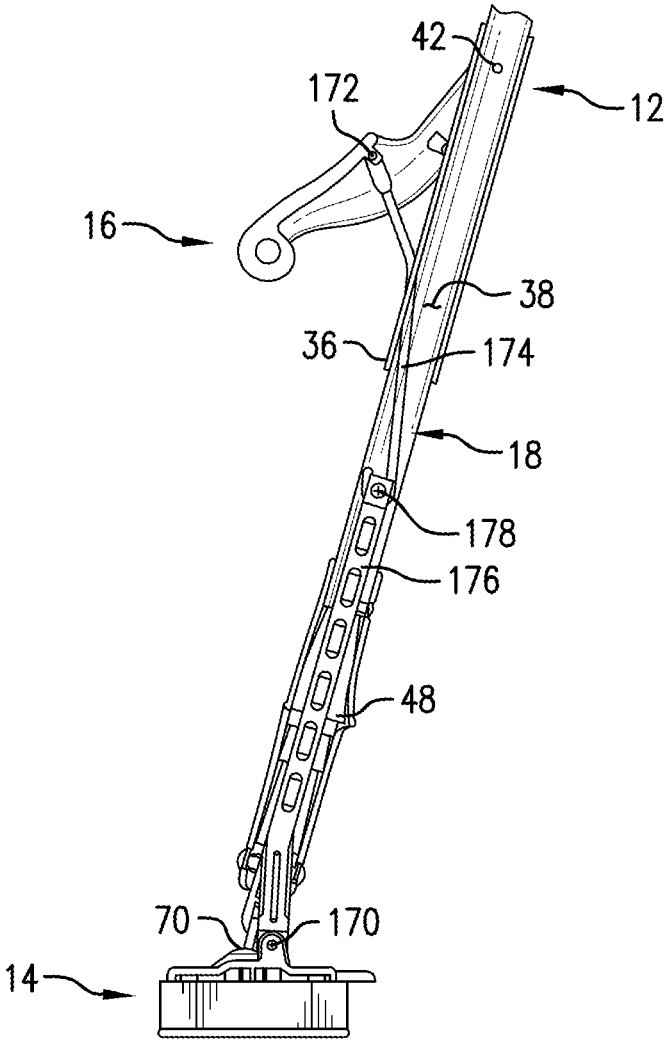
FIG. 7 is a cross-sectional view of the mop with the mop head in the use position and the actuator handle in the use operating position.

With reference back to FIG. 1, the handle rod 12 can be an assembly including a rod cap 22, a handle tube 24, an actuator handle connector 26, and a forked base section 28. The handle rod 12 is elongated, hollow and tubular in the illustrated embodiment. The handle rod 12 also defines a central handle rod axis 30. The rod cap 22 includes a hanger opening 32 extending through the rod cap 22 at an upper end 34 of the handle rod 12. The hanger opening 32 is useful for hanging the mop 10 in a manner similar to conventional mops. A slot 36 extends through both the handle tube 24 and the actuator handle connector 26 to a hollow interior space 38 (FIG. 7) of the handle rod 12. The slot 36 is elongated in a direction parallel to the central handle rod axis 30. With reference to FIG. 7, axle openings 42 (only one visible in FIG. 7) extend through the handle tube 24 and the actuator handle connector 26.

With reference to FIG. 2, the forked based section 28 of the handle rod 12 includes a first (left) tine 44 and a second (right) tine 46. With reference to FIG. 7, the forked base section 28 includes a lower central opening 48 for the handle rod 12. The lower central opening 48 opens to the hollow interior space 38 of the handle rod 12 and is centered with respect to the central handle rod axis 30. The linkage 18 extends through the lower central opening 48 to connect the actuator handle 16 with the mop head 14. With reference back to FIG. 2, the forked based section 28 also defines a first (left) link mount 52 adjacent a first (left) lower end 54 of the handle rod 12 and a second (right) link mount 56 adjacent a second (right) lower end 58 of the handle rod 12. Each link mount 52, 56 is a generally C-shaped notch in the illustrated embodiment to facilitate connection of the mop head 14 to the handle rod 12.

The mop head 14 connects with the handle rod 12 for pivotal movement with respect to the handle rod 12 about a mop head/handle rod axis 70. The mop head 14 includes a cleaning element mounting structure 72, a cleaning element 74 connected with the cleaning element mounting structure 72, and a standoff (two standoffs 76, 78 are provided in the illustrated embodiment) extending from the cleaning element mounting structure. The mop head 14 can be similar to a butterfly mop in that the cleaning element mounting structure 72 includes a first (left) plate 82, a second (right) plate 84, and a hinge plate 86 positioned between the first plate 82 and the second plate 84. With reference to FIG. 3, the first plate 82 connects with the hinge plate 86 for pivotal movement about a first wring axis 92, and the second plate 84 connects with the hinge plate 86 for pivotal movement about a second wring axis 94. The first wring axis 92 is parallel with the second wring axis 94. As apparent in FIG. 4, each wring axis 92, 94 is perpendicular to the central handle rod axis 30 when the mop head 14 is in the wring position where the first plate 82 is pivoted toward the second plate 84.

Figure 6:
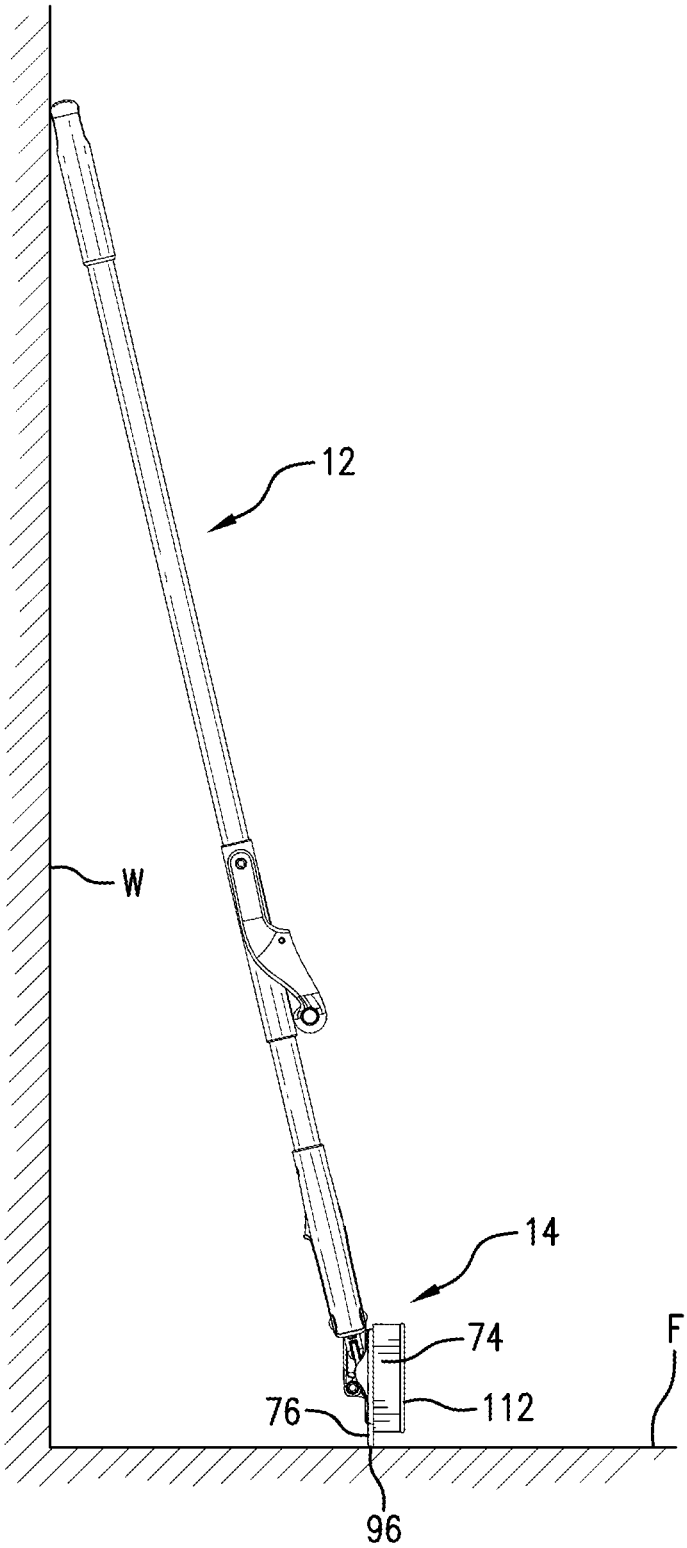
FIG. 6 is a side view of the mop shown in FIG. 1 with the mop head in a storage position and the actuator handle in a storage operating position.

Each standoff 76, 78 extends from the cleaning element mounting structure 72. Each standoff 76, 78 has a support surface 96, 98, respectively, that is configured to rest on an associated floor surface F (FIG. 6) to offset the cleaning element 74 from the floor surface when the mop head 14 is in a storage position such as that shown in FIG. 2. For example, the handle rod 12 can lean against and contact a wall W and the support surfaces 96, 98 of each standoff 76, 78 can contact the floor F and space the cleaning element 74 from the floor F, thus exposing much of the surface area of the cleaning element to ambient. In the illustrated embodiment, each standoff 76, 78 extends from a respective plate. The first standoff 76 is integrally formed with and extends from the first plate 82 and the second standoff 78 is integrally formed with and extends from the second plate 84.

With reference back to FIG. 2, the cleaning element 74 includes a first (leading) edge 102, a second (trailing) edge 104, a first (left) side 106, and second (right) side 108, a top surface 110 and a cleaning surface 112, which is a lower surface of the cleaning element. The cleaning element 74 in the illustrated embodiment is a block-shaped sponge, but it could take other configurations and be made from other materials. The cleaning element 74 can be removable from the cleaning element mounting structure 72 for cleaning and replacement.

Figure 5:
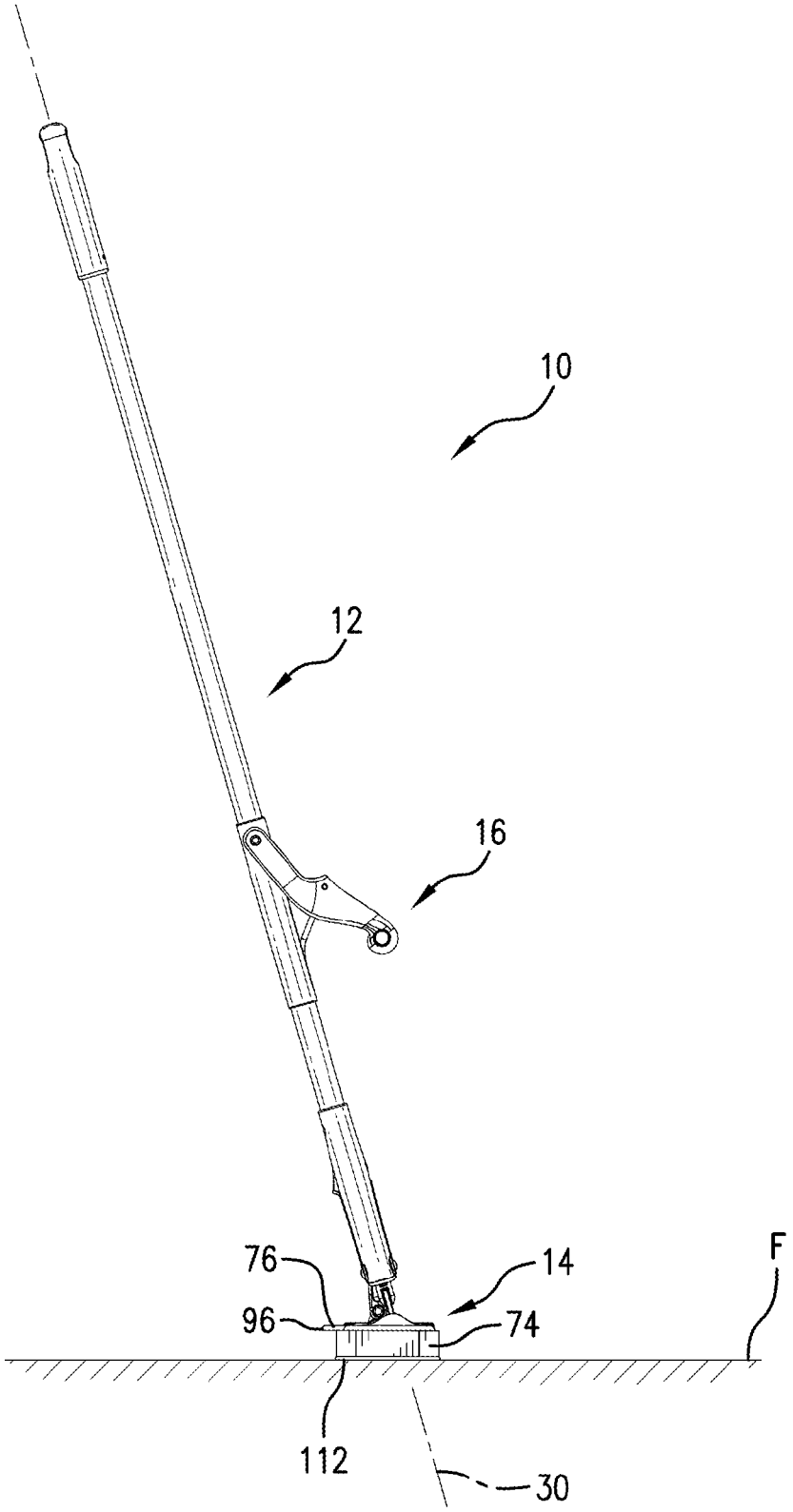
FIG. 5 is a side view of the mop shown in FIG. 1 with the mop head in the use position and the actuator handle in the use operating position.

In the illustrated embodiment, the standoffs 76, 78 extend away from the cleaning element mounting structure 72 so as to cantilever from the second (trailing) edge 104 of the cleaning element 74. If desired, the standoffs 76, 78 could extend away from cleaning element mounting structure 72 so as to cantilever from the first (leading) edge 102 of the cleaning element 74. In either case, the mop head 14 would be configured to be movable into the use position (see FIG. 5) where the cleaning surface 112 of the cleaning element 74 is nearer to normal to the central handle rod axis 30 as compared to parallel to the central handle rod axis 30, and into the storage position (FIG. 6) where the cleaning surface 112 is nearer to parallel with the central handle rod axis 30 as compared to normal to the central handle rod axis 30 and the support surface 96, 98 on the standoff 76, 78 is positioned to offset the cleaning element from a flat horizontal surface (e.g., the floor F) upon which the support surface 96, 98 rests.

The mop head 14 further includes a first upper plate link 120 and a second upper plate link 122. The first upper plate link 120 connects with a first lower plate link 124 to connect the first plate 82 of the cleaning element mounting structure 72 with the handle rod 12. The second upper plate link 122 connects with a second lower plate link 126 to connect the second plate 84 of the cleaning element mounting structure 72 with the handle rod 12. The first upper plate link 120 includes an axle 128 that is received in the first link mount 52 provided on the forked based section 28 of the handle rod 12. The second upper plate link 122 also includes an axle 130, which is received in the second link mount 56 provided on the forked base section 28. The first upper plate link 120 connects with the forked based section 28 for pivotal movement about a first plate link/handle rod pivot axis 134 that is centered with respect to the axle 128 on the first upper plate link 120. The second upper plate link 122 connects with the forked based section 28 of the handle rod 12 for pivotal movement about a second plate link/handle rod pivot axis 136 that is centered with respect to the axle 130 of the second upper plate link 122. The first lower plate link 124 connects with the first plate 82 for pivotal movement about the mop head/handle rod axis 70. Similarly, the second lower plate link 126 connects with the second plate 84 also for pivotal movement about the mop head/handle rod axis 70. The first upper plate link 120 connects with the first lower plate link 124 for pivotal movement about a first plate link axis 138. The second upper plate link 122 connects with the second lower plate link 126 for pivotal movement about a second plate link axis 140. The first plate link/handle rod pivot axis 134, the second plate link/handle rod pivot axis 136, the first plate link axis 138 and the second plate link axis 140 are all parallel to one another and perpendicular to the central handle rod axis 30.

With reference back to FIG. 2, the actuator handle 16 connects with the handle rod 12 for pivotal movement with respect to the handle rod 12 about an actuator handle/handle rod axis 142. The actuator handle 16 is movable with respect to the handle rod 12 between a use operating position (shown in FIG. 1), a storage operating position (shown in FIG. 3), and a wring operating position (shown in FIG. 4). A pin 144 is received through each axle opening 42 (FIG. 7) to attach the actuator handle 16 to the handle rod 12. The actuator handle 16 includes a grip portion 146 that is configured to be grasped by an operator to move the actuator handle 16 with respect to the handle rod 12. The actuator handle 16 also includes an arched section 148 that generally follows a radius that is the same as the radius of the actuator handle connector 26. The actuator handle 16 further include a first arm 150 and a second arm 152 extending from the arched section 148 away from the grip portion 146. The first arm 150 includes a first axle opening 154 and the second arm 152 includes a second axle opening 156, which is aligned with the first axle opening 154, and each receives the pin 144 connecting the actuator handle 16 to the handle rod 12. The arched section 148 can be resilient to provide a snap engagement of the actuator handle 16 with respect to the handle rod 12, and more particularly the actuator handle connector 26, when the actuator handle 16 is in the storage operating position shown in FIGS. 3 and 6.

The linkage 18 connects the actuator handle 16 and the mop head 14 such that movement of the actuator handle 16 results in movement of the mop head 14. With reference to FIG. 7, the linkage 18 connects with the mop head 14 for pivotal movement about a mop head/handle actuator link axis 170. The linkage 18 connects with the actuator handle 16 for pivotal movement about handle actuator/handle actuator link axis 172. In the illustrated embodiment, the linkage 18 includes a link rod 174 and a bar 176. The link rod 174 extends through the slot 36 in the handle rod 12 (and more particularly in the handle tube 24 and the actuator handle connector 26). The bar 176 connects with the actuator handle 16 for pivotal movement about the handle actuator/handle actuator link axis 172. The link rod 174 connects with the bar 176 for pivotal movement about a link rod/bar axis 178. The link rod 174 also connects with the bar 176 in a manner so that translational movement of the link rod 174 in either an upward or downward direction (per the orientation of FIG. 7) will result in translational movement of the bar 176.

As seen in FIG. 7, the mop head/handle rod axis 70 is offset from the mop head/handle actuator link axis 170. This allows the mop head 14 to move between the use position shown in FIG. 5 and the storage position shown in FIG. 6. In operation, an operator of the mop 10 can move the actuator handle 16, which is connected with the handle rod 12, with respect to the handle rod 12 into the use operating position (FIG. 5) such that the cleaning surface 112 of the cleaning element 74 on the mop head 14 is in contact with the floor surface F. When finished cleaning, the operator can aid drying the cleaning element 74 by moving the actuator handle 16 with respect to the handle rod 12 from the use operating position to the storage operating position (FIG. 6) such that the standoffs 76, 78 on the mop head 14 contact the floor surface F and the cleaning element 74 is offset from the floor surface. If the operator wants to wring out the cleaning element, this can be accomplished by moving the actuator handle 16 with respect to the handle rod 12 from the use operating position toward a wring operating position (FIG. 4) to wring out the cleaning element 74. As is apparent when comparing FIGS. 1 and 2 to FIG. 4, movement of the actuator handle 16 from the use operating position toward the wring operating position is in a first rotational direction. Movement of the actuator handle 16 from the use position (FIG. 5) toward the wring operating position (FIG. 4) pulls the link rod 174, the bar 176 and the hinge plate 86 upward toward or into the handle rod 12. The first plate 82 is able to pivot toward the second plate 84, and vice versa, because of each wring axis 92, 94, the first plate link/handle rod pivot axis 134 and the second plate link/handle rod pivot axis 136. As is apparent when comparing FIGS. 1 and 2 to FIG. 3, movement of the actuator handle from the use operating position to the storage operating position is in a second rotational direction, which is opposite the first rotational direction. Movement of the actuator handle 16 from the use position (FIG. 5) toward the storage operating position (FIG. 6) pushes the link rod 174, the bar 176 and the hinge plate 86 downward or away handle rod 12. The offset of the mop head/handle rod axis 70 from the mop head/handle actuator link axis 170 allows the mop head 14 to move between the use position and the storage position. The use operating position (FIGS. 1, 2, 5 and 7) for the actuator handle 16 is positioned between the storage operating position (FIGS. 3 and 5) and the wring operating position (FIG. 4) along both the first rotational direction and the second rotational direction.

A mop and a method of operating the mop have been described above with particularity. Modifications and alterations will occur to those upon reading and understanding the preceding detailed description. For example, an end of the linkage 18 that engages the mop head 14 could engage the mop head in front of (as compared to behind) the mop head/handle rod axis 70 and/or the end of the linkage 18 could be received in a channel and slide along a surface of the mop head 14 as opposed to the shown pivotal connection. The invention is not limited to only the embodiments described above. Instead, the invention is broadly defined by the appended claims and the equivalents thereof. It will be appreciated that various of the above-disclosed embodiments and other features and functions, or alternatives or varieties thereof, may be desirably combined into many other different applications. Also that various presently unforeseen or unanticipated alternatives, modifications, variations or improvements therein may be subsequently made by those skilled in the art which are also intended to be encompassed by the following claims.

The invention claimed is:

1. A mop comprising:

a handle rod defining a central handle rod axis;

a mop head connected with the handle rod and including a cleaning element mounting structure, a cleaning element connected with the cleaning element mounting structure, and a standoff extending from the cleaning element mounting structure; and an actuator handle connected with the handle rod and the cleaning element mounting structure and movable with respect to the handle rod for moving the mop head with respect to the handle rod between a use position and a storage position;

when the mop head is in the use position a cleaning surface of the cleaning element is nearer to normal to the central handle axis as compared to parallel to the central handle axis, when in the storage position the cleaning surface is nearer to parallel with the central handle axis as compared to normal to the central handle axis and a support surface on the standoff is positioned to offset the cleaning element from a flat horizontal surface upon which the support surface rests.

2. The mop of claim 1, wherein the actuator handle is movable between a use operating position and a storage operating position, the actuator handle and the mop head being configured such that when the actuator handle is in the use operating position the mop head is in the use position and when the actuator handle is in the storage operating position the mop head is in the storage position.

3. The mop of claim 2, wherein the actuator handle is movable in a first rotational direction from the storage operating position toward the use operating position, and the actuator handle is movable in a second, opposite, rotational direction from the use operating position toward the storage operating position.

4. The mop of claim 3, wherein the cleaning element mounting structure includes a first plate and a second plate.

5. The mop of claim 4, wherein the actuator handle is movable to a wring operating position, and movement of the actuator handle from the use operating position toward the wring operating position results in pivotal movement of the first plate toward the second plate.

6. The mop of claim 5, wherein the actuator handle is movable in the first rotational direction from the use operating position toward the wring operating position.

7. The mop of claim 6, wherein the use operating position is positioned between the storage operating position and the wring operating position along both the first rotational direction and the second rotational direction.

8. The mop of claim 4, wherein the standoff is a first standoff extending from the first plate, and the mop includes a second standoff extending from the second plate.

9. The mop of claim 1, further comprising a linkage connecting the actuator handle with the cleaning element mounting structure, wherein the mop head connects with the cleaning element mounting structure for pivotal movement about a mop head/handle rod axis and the linkage connects with the cleaning element mounting structure for pivotal movement about a mop head/handle actuator link axis.

10. The mop of claim 9, wherein an end of the linkage adjacent the cleaning element mounting structure translates with respect to the cleaning element mounting structure as the mop head moves from the use position to the storage position.

11. The mop of claim 9, wherein the mop head/handle rod axis is offset from and parallel with the mop head/actuator link axis.

12. The mop of claim 11, wherein the mop head/handle rod axis is positioned nearer to a leading edge of the mop head as compared to the mop head/actuator link axis.

13. A mop comprising:

a handle rod;

a mop head connected with the handle rod for pivotal movement with respect to the handle rod about a mop head/handle rod axis, the mop head including a first plate, a second plate, a cleaning element having a cleaning surface and a first standoff extending from the first plate having a support surface spaced from the cleaning surface, wherein the mop head pivots with respect to the handle rod about the mop head/handle rod axis between a use position where the cleaning surface is resting on an associated floor surface and the support surface is offset from the associated floor surface and a storage position where the support surface is resting on the associated floor surface and the cleaning surface is offset from the associated floor surface;

an actuator handle connected with the handle rod for pivotal movement with respect to the handle rod about an actuator handle/handle rod axis, wherein movement of the actuator handle with respect to the handle rod results in pivotal movement of the first plate toward the second plate; and a linkage connecting the actuator handle and the mop head such that movement of the actuator handle results in movement of the mop head, wherein the linkage connects with the mop head for pivotal movement about a mop head/handle actuator link axis that is parallel with the mop head/handle rod axis.

14. The mop of claim 13, wherein the handle rod defines a central handle rod axis, and when the mop head is in the use position the cleaning surface of the cleaning element is nearer to normal to the central handle axis as compared to parallel to the central handle axis, when in the storage position the cleaning surface is nearer to parallel with the central handle axis as compared to normal to the central handle axis and the support surface on the standoff is positioned to offset the cleaning element from a flat horizontal surface upon which the support surface rests.

15. The mop of claim 13, wherein the actuator handle is movable between a use operating position, a storage operating position, and a wring operating position and the actuator handle and the mop head being configured such that when the actuator handle is in the use operating position the mop head is in the use position, when the actuator handle is in the storage operating position the mop head is in the storage position and when the actuator handle is in the wring operating position the mop head is in a wring position where the first plate is pivoted toward the second plate.

16. The mop of claim 15, wherein the actuator handle is movable in a first rotational direction from the use operating position toward the wring operating position, wherein the actuator handle is movable in the first rotational direction from the storage operating position toward the use operating position, and the actuator handle is movable in a second, opposite, rotational direction from the use operating position toward the storage operating position, and wherein the use operating position is positioned between the storage operating position and the wring operating position along both the first rotational direction and the second rotational direction.

17. The mop of claim 13, wherein the mop head includes a second standoff extending from the second plate.

* * * * *